US006602090B2

(12) United States Patent
Kato

(10) Patent No.: US 6,602,090 B2
(45) Date of Patent: Aug. 5, 2003

(54) CONNECTOR

(75) Inventor: Hajime Kato, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/128,247

(22) Filed: Apr. 24, 2002

(65) Prior Publication Data

US 2002/0155751 A1 Oct. 24, 2002

(30) Foreign Application Priority Data

Apr. 24, 2001 (JP) ..... P2001-126195

(51) Int. Cl.[7] ..... H01R 13/58
(52) U.S. Cl. ..... 439/455
(58) Field of Search ..... 439/453–455, 439/466, 465, 468

(56) References Cited

U.S. PATENT DOCUMENTS 2,258,343 A * 10/1941 Walker ..... 439/455
3,781,766 A * 12/1973 Teagno et al. ..... 439/455
4,842,549 A * 6/1989 Asick et al. ..... 439/455
5,295,859 A * 3/1994 Kawai et al. ..... 439/455
5,609,499 A * 3/1997 Tan et al. ..... 439/455
6,007,370 A * 12/1999 Langridge ..... 439/455
6,106,325 A * 8/2000 Kuo ..... 439/455

FOREIGN PATENT DOCUMENTS

JP 6-231832 8/1994

* cited by examiner

*Primary Examiner*—Gary Paumen
(74) *Attorney, Agent, or Firm*—Sughrue Mion, PLLC

(57) ABSTRACT

A connector includes a connector portion in which a plurality of connecting terminals respectively connected to wire ends of electric wires are contained, a wire holding tubular part continuously provided at the connector portion for holding portions of the electric wires adjacent to the wire ends, an annular fixing member through which the electric wires are passed, and an elastic fixing member through which the electric wires are passed at a position more close to the wire ends than the annular fixing member. There are provided on inner faces of components of the wire holding tubular part, support rib projections which constitute a circumferential groove for fixing the annular fixing member at a predetermined position and a circumferential groove for locking the elastic fixing member.

6 Claims, 3 Drawing Sheets

CONNECTOR

BACKGROUND OF THE INVENTION

The present invention relates to a connector, and more particularly to protection of a terminal connecting portion in a connector for connecting a plurality of electric wires, such as a charging connector which is used for recharging an electric car.

Heretofore, there have been proposed various connectors for connecting a plurality of electric wires, such as a charging connector, for example, which connects a battery of an electric car to a charger so as to easily establish a connection between them.

FIG. 3 is a longitudinal sectional view of a connector disclosed in Japanese Publication No. JP-A-6-231832 of unexamined patent application, for example, showing inner structures of a female connector 31 which is arranged on a vehicle side (a battery side) and a male connector 32 which is arranged on a charger side.

The above described female connector 31 to be mounted on a vehicle body of a car includes a plurality of female terminals 33 contained in a housing 31*a* and connected to the battery side which is not shown. On the other hand, the above described male connector 32 is attached to one end of a cable 4 which has been drawn from the charger which is not shown. This cable 4 includes a plurality of electric wires (not shown) which have been bundled and covered, and has appropriate flexibility as a whole.

As shown in FIG. 3, the aforesaid male connector 32 has an inner case 35 which contains, in its forward end portion, a plurality of connecting terminals 38 to be respectively connected to the electric wires (not shown) in the cable 4, a sleeve 37 which is fitted around the inner case 35 and to which a locking ring 36 to be engaged with the aforesaid female connector 31 is rotatably fitted, and a connector grip 39 which is a cable holding tubular part continued from a backward end of the sleeve 37 to hold an end of the cable 4.

The aforesaid connector grip 39 is formed in a tubular shape which opens at both ends, and fitted to a backward end of the aforesaid inner case 35 in tight contact to be retained from withdrawal. On an inner face of the connector grip 39, there are provided, at an appropriate interval, a plurality of clamping ribs 40 in a ring-like shape which are adapted to be pressure contacted with an outer face of the cable 4 so as to hold the cable 4. The connector grip 39 holds the cable 4 without twisting, by means of these clamping ribs 40.

Therefore, because the aforesaid cable 4 on the side of the male connector 32 is held by the aforesaid connector grip 39 along a range of predetermined length adjacent to its end portion, the cable 4 will not directly hang down from a part connected to the connecting terminals 38, and therefore, weight of the cable 4 itself will not directly affect the part connected to the connecting terminals 38. Moreover, in a work for joining the above described female and male connectors 31, 32 to each other, alignment of both the connectors can be stably conducted by gripping the aforesaid connector grip 39, and thus, the connector engaging work will be facilitated.

However, in the connector as described above, in case where the cable to be held by the connector grip 39 includes a plurality of electric wires (cables) which have not been bundled in one, the clamping ribs 40 projectingly provided on the inner face cannot retain these electric wires.

In addition, in case where an outer diameter of the aforesaid cable 4 has been changed due to changes of the electric wires in size or number, the aforesaid connector grip 39 must be also changed in its shape or size, and the connector grip 39 is lacking in general versatility. Therefore, there has been such a problem that a plurality of the connector grips 39 for different shapes and sizes must be prepared, which may incur an increase of production cost.

SUMMARY OF THE INVENTION

In view of the above, an object of the present invention is to solve the above described problems, and to provide a favorable connector in which a terminal connecting portion in the connector to which a plurality of electric wires are connected can be reliably protected.

The above described object of the present invention will be attained by a connector comprising a connector portion in which a plurality of connecting terminals respectively connected to wire ends of a plurality of electric wires are contained, a wire holding tubular part continuously provided at a backward end of the connector portion for holding portions of the electric wires adjacent to the wire ends, an annular fixing member through which the plurality of the electric wires are passed, and an elastic fixing member through which the plurality of the electric wires are passed at a position more close to the wire ends than the annular fixing member, thereafter, the elastic fixing member being tightened by means of a fastening member around its outer peripheral part thereby to be fixed to the electric wires at a predetermined position, characterized in that there is provided, on an inner face of the wire holding tubular part, a fixing part for fixing the annular fixing member at a predetermined position.

According to the above described structure, after the plurality of the electric wires have been passed, the elastic fixing member which is elastically deformable will be tightened by the fastening member at the outer peripheral part thereby to be reduced in diameter, and fixed to these electric wires at the predetermined position.

As the results, the aforesaid elastic fixing member can be easily and reliably fixed to the predetermined position of the aforesaid electric wires, irrespective of the diameter, number, or changes in the sectional shape of the electric wires.

Then, when the aforesaid electric wires are pulled, the aforesaid elastic fixing member which has been arranged more close to the wire ends than the annular fixing member fixed to the fixing part of the wire holding tubular part will come into contact with the annular fixing member, and will be prevented from moving.

More specifically, the aforesaid elastic fixing member through which the plurality of the electric wires have been passed varies in its outer diameter, when reduced in diameter, according to differences in the diameter or number of the electric wires. However, the aforesaid elastic fixing member cannot pass through the wire insertion holes in the aforesaid annular fixing member, because the wire insertion holes are open in such a shape that the aforesaid elastic fixing member cannot pass through.

In conclusion, when the electric wires are pulled, movement of the aforesaid elastic fixing member will be restrained, and at the same time, movement of the electric wires will be also restrained. Accordingly, the plurality of the connecting terminals connected to the aforesaid wire ends will be prevented from being affected by an external force when the electric wires are pulled.

Preferably, there is provided a locking part which can lock the aforesaid elastic fixing member, at a position adjacent to the connector portion in the aforesaid fixing part on the inner face of the aforesaid wire holding tubular part.

In this case, because the elastic fixing member is locked to the locking part of the wire holding tubular part, movement of the electric wire toward the wire ends and rattling of the elastic fixing member itself can be prevented.

DETAILED DESCRIPTION OF PREFERRED EMBODIMENTS

Now, referring to the attached drawings, a connector in an embodiment according to the present invention will be described in detail.

Figure 1:
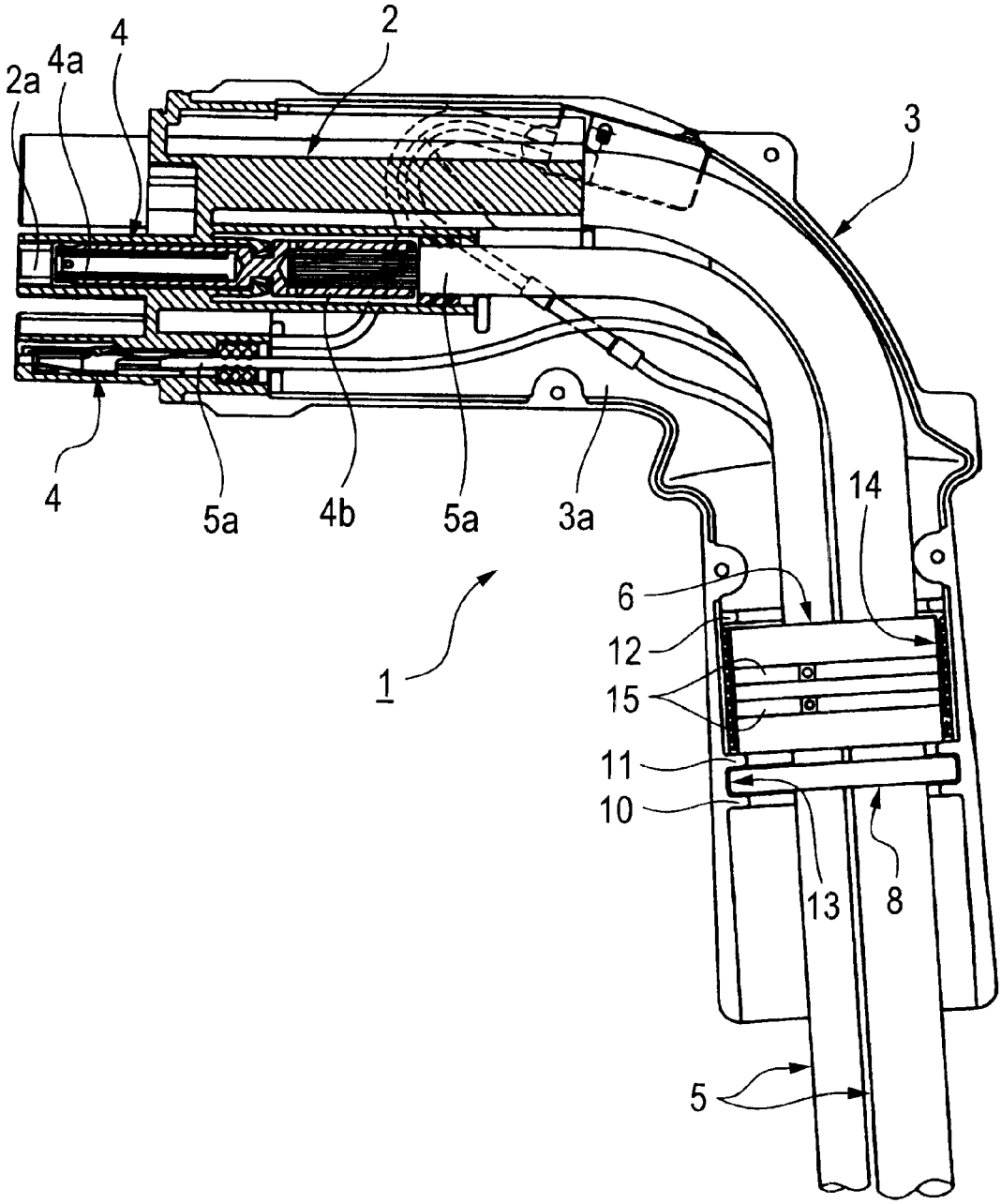
FIG. 1 is a longitudinal sectional view of a connector in an embodiment according to the present invention.
Figure 2:
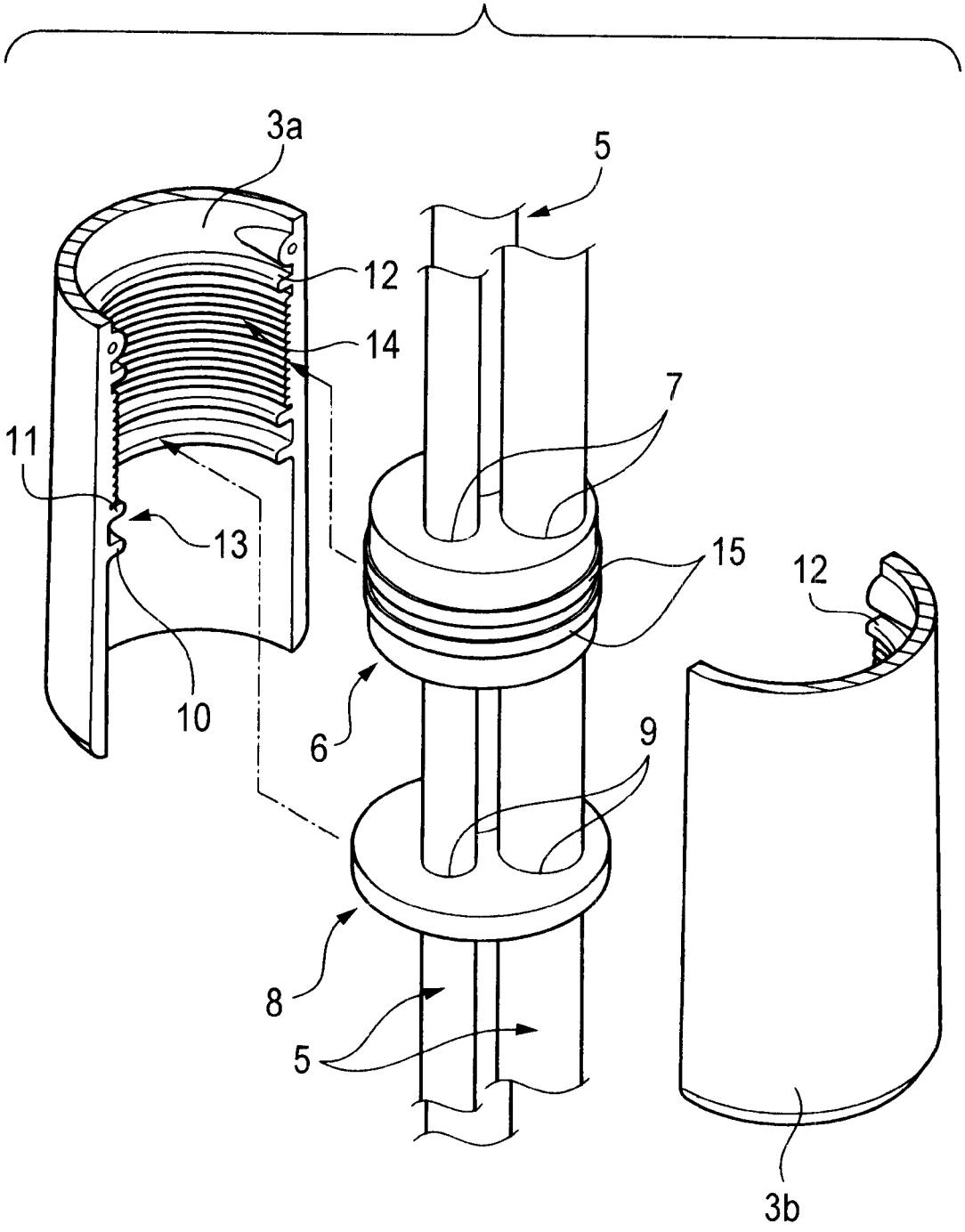
FIG. 2 is an exploded perspective view of the connector as shown in FIG. 1.
Figure 3:
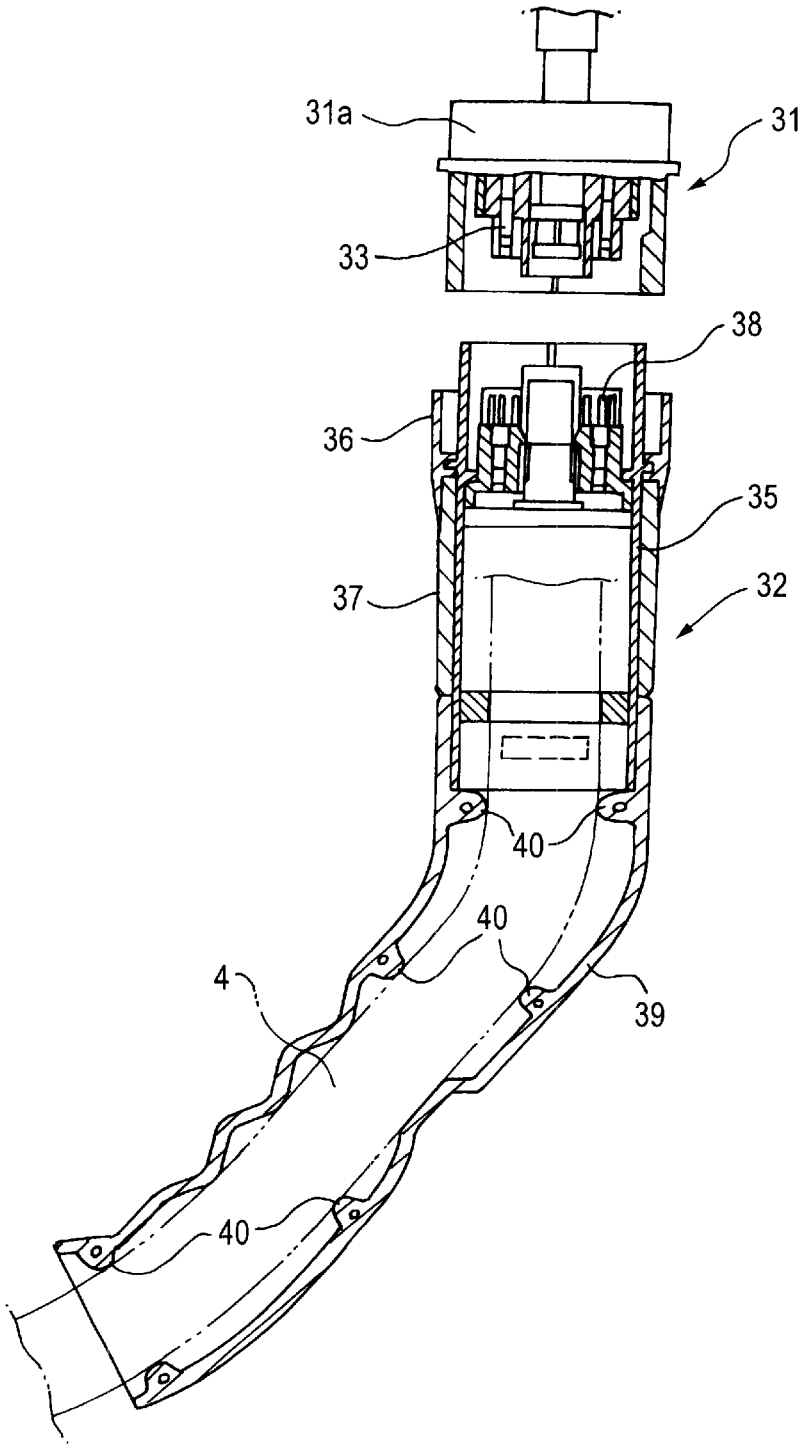
FIG. 3 is a longitudinal sectional view of a related connector.

FIG. 1 is a longitudinal sectional view of the connector in the embodiment according to the present invention, and FIG. 2 is an exploded perspective view of the connector as shown in FIG. 1.

The connector 1 in this embodiment includes, as shown in FIG. 1, a connector portion 2 in which a plurality of connecting terminals 4 respectively connected to wire ends 5*a* of a plurality of (three in this embodiment) electric wires 5 are contained, a wire holding tubular part 3 which is continuously provided at a backward end of the connector portion 2 for holding portions of the electric wires adjacent to the aforesaid wire ends Sa, an annular fixing member 8 through which the aforesaid plurality of the electric wires 5 are passed, and an elastic fixing member 6 through which the aforesaid plurality of the electric wires are passed at a position more close to the wire ends 5*a* than the annular fixing member 8.

The above described connector 1 is a male connector attached to one ends of the electric wires 5 which have been drawn from a charger which is not shown, and adapted to be engaged with a female connector arranged on a vehicle body side (a battery side) which is not shown. In this connection, detailed description of the female connector attached to the vehicle body of a car will be omitted, because the female connector has a substantially same structure as in the related art.

The aforesaid connector portion 2 includes a plurality of connecting terminals 4 respectively contained in terminal containing chambers 2*a* which are formed through a housing formed of resin. Each of the connecting terminals 4 has a connecting terminal portion 4*a* at its forward end and a wire crimping portion 4*b* at its backward end, and connected to each wire end 5*a* of the electric wire 5.

The aforesaid wire holding tubular part 3 has a half divided structure in which a tubular housing which opens at both ends is longitudinally divided in two as shown in FIG. 2. In this embodiment, the wire holding tubular part 3 is bent substantially at a right angle at an intermediate position thereof.

One end portions of respective components 3*a*, 3*b* of the wire holding tubular part 3 which has been divided in two are fitted to the connector portion 2 so as to clamp an outer peripheral face of a backward end portion of the connector portion 2, and retained from withdrawal.

The components 3*a* and 3*b* of the aforesaid wire holding tubular part 3 are respectively provided, on their inner faces, as shown in FIGS. 1 and 2, with supporting rib projections 10, 11, 12 which constitute a groove 13 in a circumferential direction acting as a fixing part for fixing the aforesaid annular fixing member 8 at a predetermined position, and a groove 14 in a circumferential direction acting as a locking part for locking the aforesaid elastic fixing member 6.

Specifically, when the components 3*a* and 3*b* of the aforesaid wire holding tubular part 3 are engaged with each other, the aforesaid annular fixing member 8 is fitted in the circumferential groove 13 formed between the supporting rib projections 10 and 11, and the aforesaid elastic fixing member 6 is fitted in the circumferential groove 14 formed between the supporting rib projections 11 and 12. In this manner, the annular fixing member 8 and the elastic fixing member 6 are respectively positioned and fixed with respect to the wire holding tubular part 3.

As shown in FIG. 2, the annular fixing member 8 is a member in a ring-like shape formed of hard resin material and having a plurality of wire insertion holes 9. The electric wires 5 are passed through these wire insertion holes 9.

On the other hand, the aforesaid elastic fixing member 6 is a member in a columnar shape formed of rubber material and having a plurality of wire insertion holes 7. After the wire ends 5*a* of the plurality of the electric wires 5 have been passed through the wire insertion holes 7, the elastic fixing member 6 in a state set at a predetermined position of the electric wires 5 is tightened by means of fastening members 15 at its outer peripheral part.

Then, the elastic fixing member 6 which is elastically deformable will tighten the electric wires 5 which have been reduced in diameter and passed through the wire insertion holes 7, and consequently, will be fixed to the electric wires 5 at the predetermined position so as not to move relative to each other.

As the results, the aforesaid elastic fixing member 6 can be fixed to the aforesaid electric wires 5 easily and reliably, irrespective of changes in diameter or sectional shape, or decrease in number of the electric wires 5.

As the fastening member 15, a tightening band formed of resin or a crimping ring formed of metal can be used.

For reference, the predetermined position of the electric wires 5 at which the aforesaid elastic fixing member 6 is to be fixed designates such a position that intermediate parts of the electric wires 5 between the wire ends 5*a* to which the aforesaid connecting terminals 4 are connected and portions to which the aforesaid elastic fixing member 6 is fixed can have a length to allow slack, when they are arranged and held in the aforesaid wire holding tubular part 3.

Now, an assembling procedure of the connector 1 in this embodiment described above will be explained.

As a first step, the connecting terminals 4 connected to the aforesaid wire ends Sa are contained in the terminal containing chambers 2*a* of the connector portion 2, and as shown, for example, in FIG. 1, the connector portion 2 is fitted in one end of the component 3*a* of the wire holding tubular part 3. At the same time, the aforesaid elastic fixing member 6 which has been fixed at the predetermined position of the electric wires 5 is fitted in the aforesaid circumferential groove 14.

On this occasion, the aforesaid annular fixing member 8 is also fitted in the aforesaid circumferential groove 13. However, the annular fixing member 8 is relatively movable with respect to the electric wires 5, and can be easily fitted in the circumferential groove 13.

Thereafter, by assembling the aforesaid component 3*b* to the component 3*a* of the aforesaid wire holding tubular part 3, the outer peripheral face of the aforesaid connector portion 2 at the backward end will be clamped and retained so as not to be withdrawn. At the same time, the aforesaid elastic fixing member 6 and the aforesaid annular fixing member 8 will be respectively fitted in the aforesaid circumferential grooves 14, 13, and fixed to the wire holding tubular part 3. As the results, the portions of the electric wires 5 adjacent to the wire ends 5*a* will be arranged and held in the aforesaid wire holding tubular part 3.

Specifically, due to the fact that the aforesaid elastic fixing member 6 is locked in the aforesaid circumferential groove 14 constituting a locking part of the wire holding tubular part 3, movement of the fixed electric wires 5 toward the wire ends 5*a* and rattling of the aforesaid elastic fixing member 6 itself can be prevented.

Moreover, when the electric wires 5 are pulled with respect to the wire holding tubular part 3, movement of the aforesaid elastic fixing member 6 will be restrained because a circumferential edge of the elastic fixing member 6 is abutted against the supporting rib projections 11 constituting the aforesaid circumferential groove 14, and so, movement of the electric wires 5 will be also restrained.

However, the aforesaid elastic fixing member 6 is formed of rubber material which is elastically deformable, and when the outer peripheral part has been tightened by the aforesaid fastening members 15, an outer diameter of the elastic fixing member 6 when reduced in diameter will change according to differences in the diameter or sectional shape of the electric wires 5. On this occasion, a margin at the circumferential edge of the elastic fixing member 6 to be abutted against the aforesaid supporting rib projection 11 will be decreased. Further, when the aforesaid electric wires 5 are pulled with force, the edges of the elastic fixing member 6 may be crushed.

Under the circumstances, there is such probability that the aforesaid elastic fixing member 6 may be detached from the aforesaid supporting rib projection 11.

However, the wire insertion holes 9 in the annular fixing member 8 fixed to the aforesaid wire holding tubular part 3 are open in such a shape that the aforesaid elastic fixing member 6 cannot pass through the wire insertion holes 9, the elastic fixing member 6 will come into contact with an end face of the annular fixing member 8 and will be unable to pass it through.

Accordingly, even when the electric wires 5 are pulled with force, movement of the aforesaid elastic fixing member 6 will be restrained, and at the same time, movement of the electric wires 5 will be also restrained.

Therefore, the plurality of the connecting terminals 4 connected to the aforesaid wire ends 5*a* will not be affected by an external force when the electric wires 5 are pulled, nor directly affected by weight of the electric wires 5 themselves.

As the results, although the plurality of the electric wires 5 which have not been bundled in one are connected, the connector 1 in the present embodiment can advantageously maintain the connection between the connecting terminals 4*a* and mating connecting terminals, as well as the connection at the wire crimping portions 4*b*, because the aforesaid elastic fixing member 6 can be easily and reliably fixed to the electric wires 5, and therefore, reliability of the connector will be enhanced.

In addition, because the above described plurality of the electric wires 5 are passed through the annular fixing member 8 and the elastic fixing member 6, and tightened by means of the fastening members 15 via the elastic fixing member 6 to be bundled, the plurality of the wire ends 5*a* will be prevented from coming apart. In this manner, assembling workability when the plurality of the connecting terminals 4 are assembled to the connector portion 2 will be also enhanced.

It goes without saying that the structures of the wire holding tubular part, the annular fixing member, the elastic fixing member, and the fixing part provided on the inner face of the aforesaid wire holding tubular part, and so on are not limited to the structures in the above described embodiment, but various structures can be employed according to a concept of the present invention.

For example, in the above described embodiment, shapes of the plurality of (three) the wire insertion holes 7 formed in the aforesaid elastic fixing member 6 are substantially consistent with the diameters and the sectional shapes of the electric wires 5 to be passed through. However, because the aforesaid elastic fixing member 6 will be reduced in diameter when it is tightened by the aforesaid fastening members 15 so as to be fixed to the electric wires 5, small differences in the diameter or the sectional shape of the electric wires can be absorbed.

Further, it will be possible to exchange only the aforesaid elastic fixing member 6 and the aforesaid annular fixing member 8, in the event that the diameters or the sectional shapes of the aforesaid electric wires 5 are changed to larger ones, or the electric wires 5 are increased in number. Because the aforesaid wire holding tubular part need not be changed, and has general versatility, an increase of the production cost for the connector will be eliminated.

Furthermore, the annular fixing member 8 in the above described embodiment is provided with the plurality of the wire insertion holes 9 respectively having the shapes substantially consistent with the diameters and the sectional shapes of the electric wires 5 which are adapted to be passed therethrough. However, the shapes and the number of the wire insertion holes 9 are not limited to those described in the embodiment, provided that the aforesaid elastic fixing member 6 may come into contact with the end face of the annular fixing member 8 and cannot pass through. For example, only one opening can constitute the wire insertion hole, provided that an inner diameter of the wire insertion hole in the aforesaid annular fixing member is sufficiently smaller than the outer diameter of the aforesaid elastic fixing member 6.

According to the connector of the present invention as described above, after the plurality of the electric wires have been passed, the elastic fixing member which is elastically deformable will be tightened by the fastening member at the outer peripheral part thereby to be reduced in diameter, and fixed to these electric wires at the predetermined position.

As the results, the aforesaid elastic fixing member can be easily and reliably fixed to the predetermined position of the aforesaid electric wires, irrespective of the diameters, number, or changes in the sectional shapes of the electric wires.

Then, when the aforesaid electric wires are pulled, the aforesaid elastic fixing member which has been arranged more close to the wire ends than the annular fixing member fixed to the fixing part of the wire holding tubular part will come into contact with the annular fixing member, and will be prevented from moving.

More specifically, the aforesaid elastic fixing member through which the plurality of the electric wires have been passed varies in its outer diameter, when reduced in diameter, according to differences in the diameter or number of the electric wires. However, the aforesaid elastic fixing member cannot pass through the wire insertion holes in the aforesaid annular fixing member, because the wire insertion holes are open in such a shape that the aforesaid elastic fixing member cannot pass through.

In conclusion, when the electric wires are pulled, movement of the aforesaid elastic fixing member will be restrained, and at the same time, movement of the electric wires will be also restrained. Accordingly, the plurality of the connecting terminals connected to the aforesaid wire ends will be prevented from being affected by an external force when the electric wires are pulled.

Therefore, it is possible to provide a favorable connector in which a terminal connecting portion in the connector to which a plurality of electric wires are connected can be reliably protected.

What is claimed is:

1. A connector comprising:

a connector portion in which a plurality of connecting terminals respectively connected to wire ends of a plurality of electric wires are contained;

a wire holding tubular part, for holding portions of the electric wires adjacent to the wire ends, continuously provided at the connector portion;

an annular fixing member through which the plurality of the electric wires are passed;

an elastic fixing member through which the plurality of the electric wires are passed at a position more close to the wire ends than the annular fixing member;

a fastening member for tightening an outer peripheral part of the elastic fixing member to position the electric wires at a predetermined position; and a fixing part, for fixing the annular fixing member at a predetermined position, provided on an inner face of the wire holding tubular part.

2. The connector according to claim 1, wherein a locking part, for locking the elastic fixing member, is provided on the inner face of the wire holding tubular part at a position more close to the connector portion than the fixing part.

3. The connector according to claim 1, wherein the fixing part includes a groove with which the annular fixing member is engaged.

4. The connector according to claim 2, wherein the locking part includes a groove with which the elastic fixing member is engaged.

5. The connector according to claim 1, wherein the annular fixing member includes a plurality of holes through which the plurality of electric wires are passed, respectively.

6. The connector according to claim 1, wherein the elastic fixing member includes a plurality of holes through which the plurality of electric wires are passed, respectively.

* * * * *